US008991828B2

(12) United States Patent
Chen

(10) Patent No.: US 8,991,828 B2
(45) Date of Patent: Mar. 31, 2015

(54) DARTBOARD

(76) Inventor: Te-Tsao Chen, Buena Park, CA (US)

( * ) Notice: Subject to any disclaimer, the term of this patent is extended or adjusted under 35 U.S.C. 154(b) by 234 days.

(21) Appl. No.: 13/463,748

(22) Filed: May 3, 2012

(65) Prior Publication Data

US 2013/0292906 A1 Nov. 7, 2013

(51) Int. Cl.
*F41J 3/00* (2006.01)

(52) U.S. Cl.
CPC ..... *F41J 3/0066* (2013.01); *F41J 3/0085* (2013.01); *F41J 3/0095* (2013.01); *Y10T 29/49826* (2013.01)
USPC ..... 273/408; 273/403

(58) Field of Classification Search
CPC ..... F41J 3/0066; F41J 3/0095; F41J 3/0085; F41J 3/009; F41J 3/0071; F41J 3/0076; F41J 3/008; F41J 3/0009; F41J 5/052
USPC ..... 273/403, 404, 407, 408
See application file for complete search history.

(56) References Cited

U.S. PATENT DOCUMENTS

| | | | | |
|---|---|---|---|---|
| 4,239,573 | A * | 12/1980 | Wu | 156/245 |
| 4,430,789 | A * | 2/1984 | Wu | 29/527.1 |
| 4,790,541 | A * | 12/1988 | Lin | 273/408 |
| 5,417,437 | A * | 5/1995 | Coppard et al. | 273/403 |
| 6,659,465 | B2 * | 12/2003 | Yiu | 273/374 |
| 2003/0193144 | A1 * | 10/2003 | Yiu | 273/408 |
| 2004/0084846 | A1 * | 5/2004 | Tsai et al. | 273/371 |
| 2005/0093242 | A1 * | 5/2005 | Lai | 273/408 |
| 2007/0001400 | A1 * | 1/2007 | Stewart | 273/348 |
| 2007/0296152 | A1 * | 12/2007 | Chen | 273/408 |
| 2008/0073850 | A1 * | 3/2008 | Chen | 273/403 |
| 2009/0121439 | A1 * | 5/2009 | Sierakowski | 273/408 |
| 2013/0292906 | A1 * | 11/2013 | Chen | 273/408 |

* cited by examiner

*Primary Examiner* — Mark Graham
(74) *Attorney, Agent, or Firm* — Raymond Y. Chen; David and Raymond Patent Firm

(57) ABSTRACT

A dartboard includes a board frame and a plurality of target blocks coupled at the board frame. Each target block includes a block body, a predetermined amount of target materials, and a block panel. The block body has a material compartment and two openings aligning with the material compartment. The target materials are made of sisals and filled within the material compartment. The block panel is affixed to one of the openings of the block body to form a bottom panel of the respective block body so as to retain bottom of the target material within the material compartment of the block body.

10 Claims, 4 Drawing Sheets

DARTBOARD

BACKGROUND OF THE PRESENT INVENTION

1. Field of Invention

The present invention relates to a dartboard, and more particular to a target block of the dartboard and its fabrication process, which simplifies the process to enhance the mass production of the dartboard.

2. Description of Related Arts

A conventional dartboard comprises a plurality of gradually decreased concentric circles and radially extending ribs which are intersected to define a plurality of sectional target areas, wherein a plurality of sectional dartboard blocks are fixed to the sectional target areas respectively. Accordingly, the surface of sectional target blocks located in the same fan-shaped radial strip have the same color, while the surface of the sectional target blocks located in different fan-shaped radial strips have different colors. In particular, the target blocks located in the same fan-shaped radial strip represent the same score, and the target blocks located in different fan-shaped radial strips represent different scores. However, the fan-shaped radial strips which are separated and distinguished according to two different colors and the scores shown thereon may be misjudged and thus cause some inconvenience.

Moreover, crevices may occur or increase in a conventional dartboard after darts are hit and removed from the dartboard over a long period of time, which may cause the dart tip cannot be fixed when it hits the dartboard and ultimately impacts on the score calculation.

In addition, sine the sectional target blocks are affixed to the sectional target areas respectively, the used sectional target block cannot be replaced by a new one. In other words, when one of the sectional target blocks is damaged, the entire dartboard must be replaced.

SUMMARY OF THE PRESENT INVENTION

The invention is advantageous in that it provides a fabrication process of a dartboard, which simplifies the process to enhance the mass production of the dartboard.

Another advantage of the invention is to a fabrication process of a dartboard, which improves the quality of the target block of the dartboard while being cost effective.

Another advantage of the invention is to a target block of the dartboard, wherein no crevice will be formed after the dart is hit and removed from the target block.

Another advantage of the invention is to a target block of the dartboard, wherein the target block can be removed and replaced from the dartboard.

Another advantage of the invention is to a target block of the dartboard, which does not require to alter the original structural design of the dartboard, so as to minimize the manufacturing cost of the dartboard incorporating with the target block.

Another advantage of the invention is to a target block of the dartboard, wherein no expensive or complicated structure is required to employ in the present invention in order to achieve the above mentioned objects. Therefore, the present invention successfully provides an economic and efficient solution for making the dartboard with the target blocks.

Additional advantages and features of the invention will become apparent from the description which follows, and may be realized by means of the instrumentalities and combinations particular point out in the appended claims.

According to the present invention, the foregoing and other objects and advantages are attained by a dartboard comprising a board frame and a plurality of target blocks coupled at the board frame. Each target block includes a block body, a predetermined amount of target materials, and a block panel. The block body has a material compartment and two openings aligning with the material compartment. The target materials are made of sisals and filled within the material compartment. The block panel is affixed to one of the openings of the block body to form a bottom panel of the respective block body so as to retain bottom of the target material within the material compartment of the block body.

In accordance with another aspect of the invention, the present invention comprises a fabrication process of a dartboard, comprising the steps of:

(a) configuring target materials in a bundle form to form a sisal bar, wherein the target materials are made of sisals;

(b) guiding the sisal bar to extend through one or more hollow block bodies, each of the block bodies having a material compartment and two openings aligning with the material compartment, wherein the sisal bar is filled with the material compartments of the block bodies;

(c) cutting the sisal bar at the two openings of each of the block bodies for fitting the target material in the material compartment of the block body;

(d) affixing a block panel to one of the openings of each the block body to a target block, wherein the block panel forms a bottom panel of the respective block body so as to retain bottom of the target material within the material compartment of the block body; and (f) coupling the target blocks on a board frame to form the dartboard.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
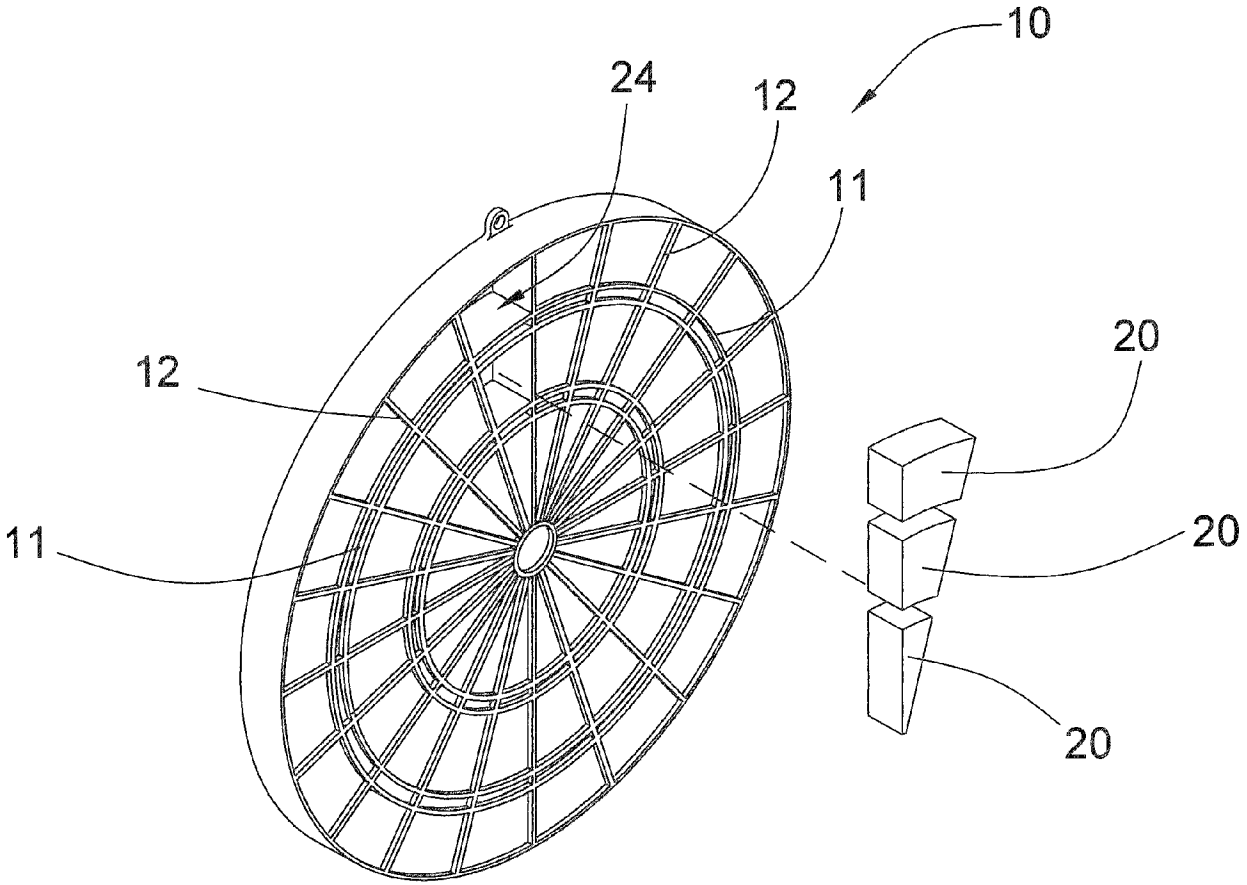
FIG. 1 is a perspective view of a dartboard according to a preferred embodiment of the present invention.
Figure 2:
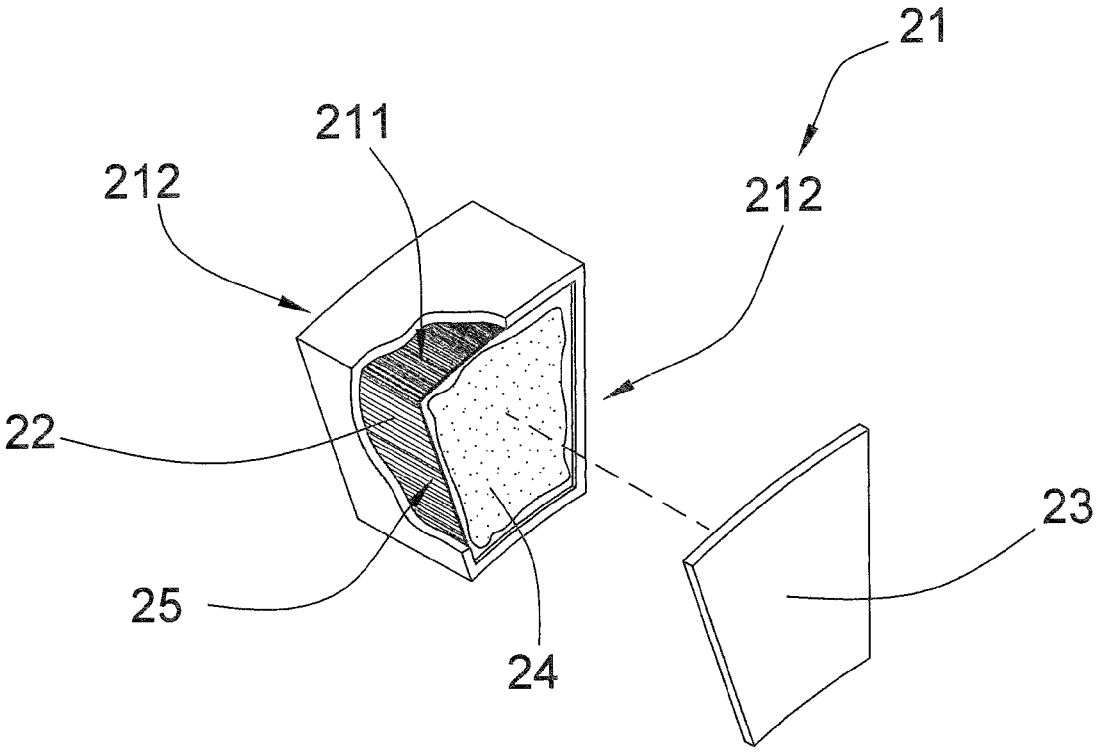
FIG. 2 is a perspective view of a target block of the dartboard according to the above preferred embodiment of the present invention.

Referring to FIGS. 1 and 2, a dartboard according to a preferred embodiment of the present invention is illustrated, wherein the dartboard comprises a board frame 10 and a plurality of target blocks 20 coupled at the board frame 10.

According to the preferred embodiment, the board frame 10 comprises a plurality of concentric ribs 11 and radially extending rectilinear ribs 12 which are intersected with the concentric ribs 11 to form a plurality of receiving recesses 24 on the board frame 10.

The target blocks 20 are disposed at the receiving recesses 24 of the board frame 10 respectively. Each of the target blocks 20 comprises a block body 21, a predetermined amount of target materials 22, and a block panel 23.

The block body 21, which is preferably made of plastic, has a material compartment 211 and two openings 212 aligning with the material compartment 211. In particular, the material compartment 211 has an elongated structure that the two openings 212 are aligned with each other through the material compartment 211. Accordingly, the block bodies 21 can be configured with different sizes, shapes, and cross sections corresponding to the size and shape of the receiving recess 24.

The target materials 22 are made of sisals and filled within the material compartment 211 of the block body 21. Accordingly, the target materials 22 are long sisal raw material being compressed and formed in a bundle configuration to form an elongated sisal bar to pass through the block body 21. The sisal bar is then cut at the two openings 212 of the block body 21 for fitting the target material 22 in the material compartment 211 of the block body 21.

The block panel 23 is affixed to one of the openings 212 of the block body 21 to form a bottom panel of the respective block body 21 so as to retain bottom of the target materials 22 within the material compartment 211 of the block body 21.

As shown in FIG. 2, the block panel 23 is detachably coupled with the respective block body 21. In other words, the block body 21 and the block panel 23 are two individual components before the target materials 22 are filled in the block body 21. Therefore, after the target materials 22 are filled within the material compartment 211, the block panel 23 is affixed to couple with the block body 21 and to close the respective opening 212 thereof.

Figure 5:
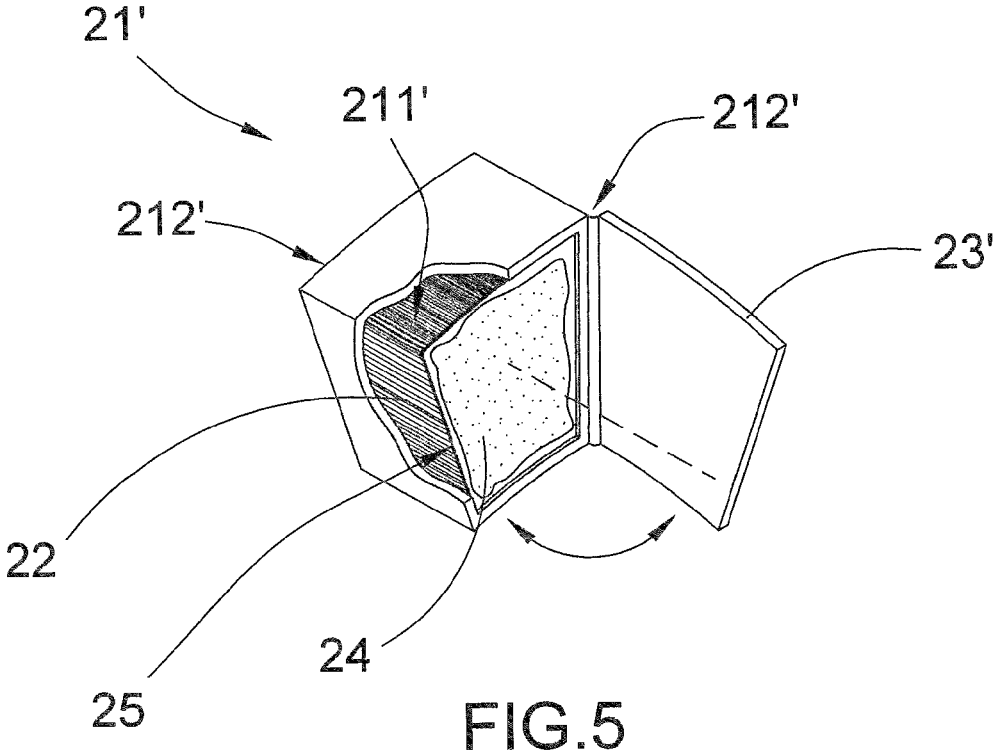
FIG. 5 illustrates an alternative mode of the target block of the dartboard according to the above preferred embodiment of the present invention.

Alternatively, an edge of the block panel 23' is foldably coupled with an edge of the respective block body 21' at one of the openings 212' thereof. In other words, the block panel 23' is integrated with the block body 21' edge-to-edge, wherein the block panel 23' forms a cover panel before the target materials 22 are filled in the block body 21'. Therefore, after the target materials 22 filled within the material compartment 211', the block panel 23' is folded to couple with the block body 21' and to close the respective opening 212' thereof, as shown in FIG. 5.

According to the preferred embodiment, each of the target blocks 20 further comprises an adhering element 24 to adhere the bottom of the target materials 22 to the block panel 23. In other words, the bottom of the target materials 22 is adhered to the block panel 23 to retain the target materials 22 within the material compartment 211.

Each of the target blocks 20 comprise a cushioning element 25 provided at the bottom of the target materials 22 to couple with the block panel 23. According to the preferred embodiment, the cushioning element 25 can be made of rubber or EVA foaming material to form the cushion bottom of the target materials 22. It is worth mentioning that the cushioning element 25 is provided at the inner side of the block panel 23, wherein the adhering element 24 can be applied to the cushioning element 25 such that the bottom of the target materials 22 can be affixed to the block panel 23 with cushioning effect.

Figure 3:
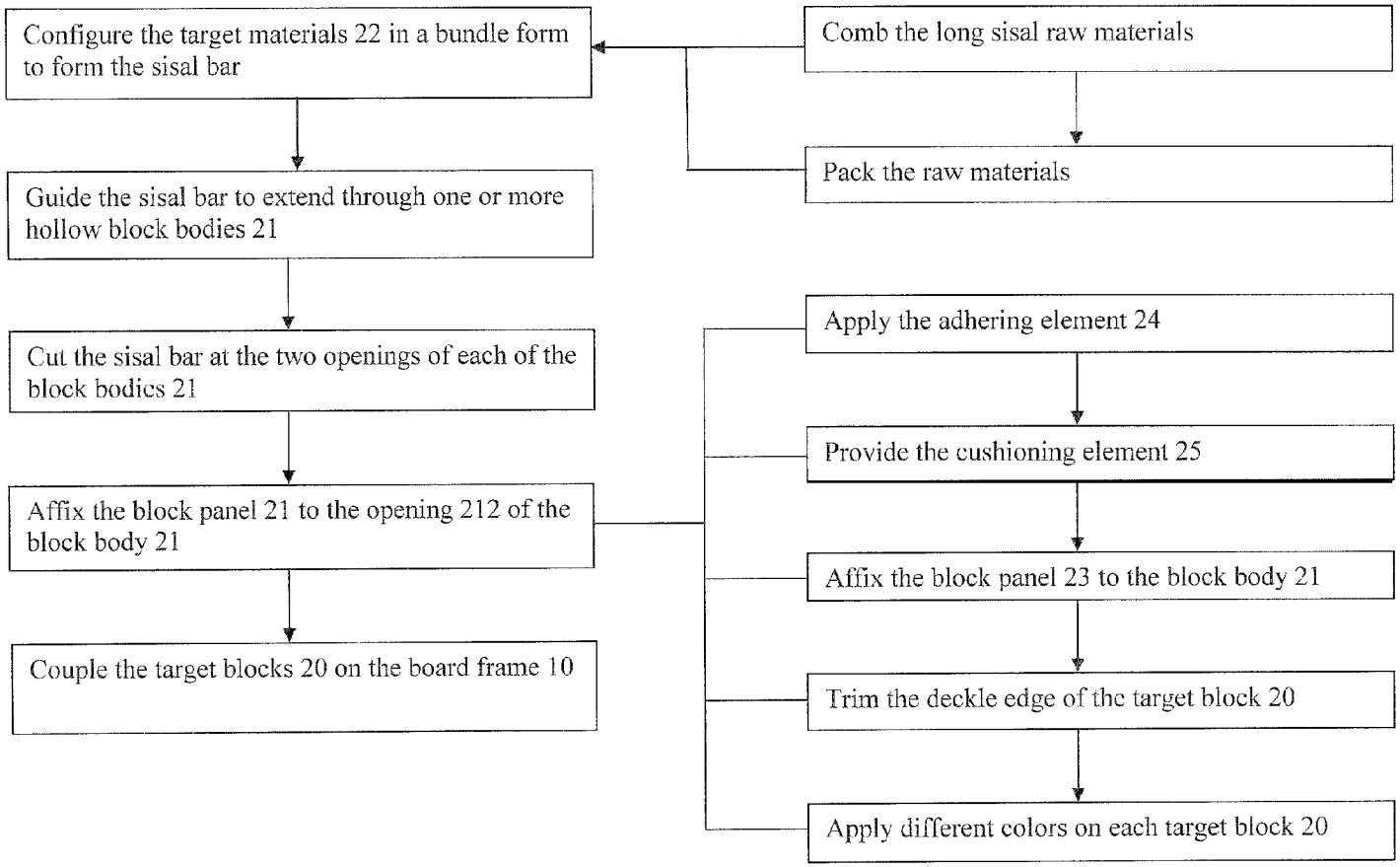
FIG. 3 is a block diagram illustrating the fabrication process of the dartboard according to the above preferred embodiment of the present invention.
Figure 4:
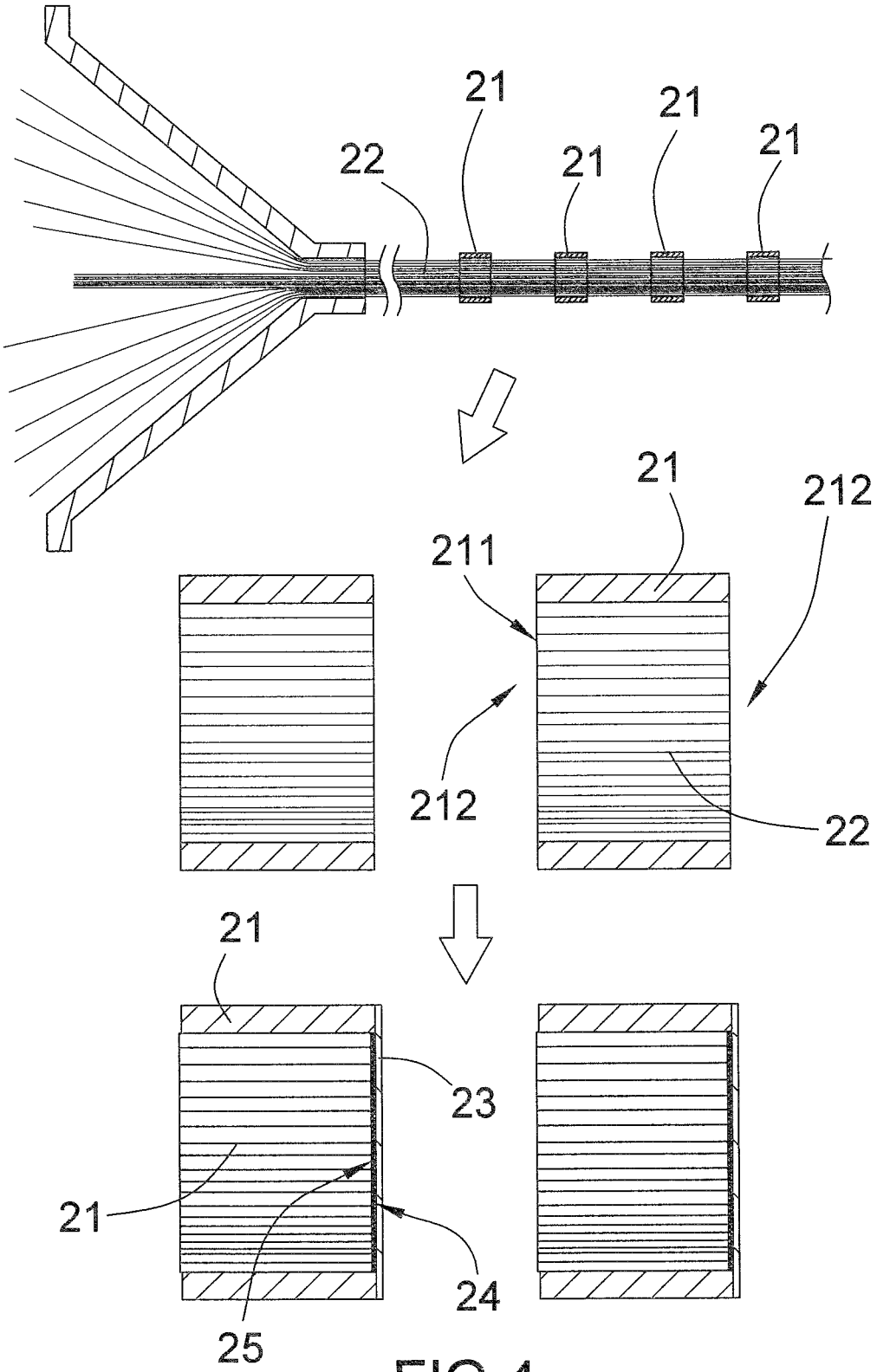
FIG. 4 is a flow diagram illustrating the fabrication process of the dartboard according to the above preferred embodiment of the present invention.

As shown in FIGS. 3 and 4, the present invention further provides a fabrication process of a dartboard, comprising the following steps.

(1) Configure the target materials 22 in a bundle form to form the sisal bar.

(2) Guide the sisal bar to extend through one or more hollow block bodies 21.

(3) Cut the sisal bar at the two openings of each of the block bodies 21 for fitting the target materials 22 in the material compartment 211 of the block body 22.

(4) Affix the block panel 21 to one of the openings 212 of each block body 21 to form the target block 20.

(5) Couple the target blocks 20 on the board frame 10 to form the dartboard. In particular, the target blocks 20 are disposed at the receiving recesses 24 of the board frame 10 respectively.

According to the preferred embodiment, in the step (1), the target materials 22 are bundled by the following steps.

(1.1) Comb the long sisal raw materials used for the target materials, wherein bad sisal raw materials are picked and removed to ensure the quality of the target materials.

(1.2) Pack the raw materials by a hemp packing machine to compress and collect the raw materials in a bundle form so as to form the elongated sisal bar. It is worth mentioning that the amount of raw materials being bundled together is predetermined according to the cross sectional area of the block body 21. In other words, the cross section of the sisal bar should match with the cross section of the block body 21.

Accordingly, the tightness of the sisal bar impacts the dart shooting and pulling. If the sisal made target materials are too tight, the dart cannot be shot and pulled easily. It the sisal made target materials are too loose, the shot dart cannot station at the target block 20. The moderate sisal can make the dart shoot and pull easily. It can expand to fill in the hole that is shot by the dart when the dart is pulled out, such that no crevice will be formed after the dart is hit and removed from the target block. The raw materials being wrapped and packed can produce the target blocks 20 with proper tightness via the hemp packing machine for easy shooting and pulling.

In the step (2), the sisal bar is slidably passing through a plurality of the block bodies 21. Accordingly, the block bodies 21 are aligned with each other that the material compartments 211 of the block bodies 22 are aligned to from an elongated channel for the sisal bar passing therethrough. The numbers of block bodies 21 being aligned with each other depend on the length of the sisal bar.

In particular, the sisal bar is compressed that the cross section of the sisal bar is slightly smaller than the cross section of the block body 21. Therefore, after the sisal bar is guided to pass through the material compartment 211 of the block body 21, the sisal bar 21 will be expanded to bias against the inner wall of the material compartment 211 of the block body 21, so as to ensure the target materials 22 being fitted in the material compartment 211 of the block body 21.

As it is mentioned above, the sisal bar is slidably passing through two or more block bodies 21. When the sisal bar is cut in the step (3), the semi-product of the target block 20 is formed. Accordingly, a predetermined number of the semi-products can be formed at the same time to enhance the mass production of the target blocks 20. It is worth mentioning that the cross section of the block bodies 21 should be the same in order to enable the sisal bar passing therethrough.

In the step (4), the present invention further comprises the following steps.

(4.1) Apply the adhering element 24 to adhere the bottom of the target materials 22 to the block panel 23.

(4.2) Provide the cushioning element 25 at the bottom of the target materials to couple with the block panel.

(4.2) Affix the block panel 23 to the block body 21 to enclose the respective opening 212 thereof.

(4.3) Trim the deckle edge of each of the target blocks 20 to avoid the partial lengthy sisals from protruding.

(4.4) Apply different colors on each target block 20 (e.g. applying red color on the red target block 20) to distinguish the different scoring blocks 20.

Accordingly, the steps (4.1) and (4.2) can be formed in one single step of applying the adhering element 24 to the cushioning element 25 such that the bottom of the target materials 22 can be affixed to the block panel 23 with cushioning effect.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A fabrication process of a dartboard, comprising the steps of:

(a) configuring target materials in a bundle form to form a sisal bar, wherein said target materials are made of sisals;

(b) guiding said sisal bar to extend through one or more hollow block bodies, each of said block bodies having a material compartment and two openings aligning with said material compartment, wherein said sisal bar fills said material compartments of said block bodies;

(c) cutting said sisal bar at said two openings of each of said block bodies for fitting said target materials in said material compartment of said block body;

(d) affixing a block panel to one of said openings of each said block body to form a target block, wherein said block panel forms a bottom panel of said respective block body so as to retain bottom of said target materials within said material compartment of said block body; and (f) coupling said target blocks on a board frame to form said dartboard.

2. The process as recited in claim 1, the step (b), wherein said target materials are compressed in a bundle form to form said sisal bar and are packed and retained by said block body after said sisal bar passes through said block body.

3. The process, as recited in claim 1, wherein the step (d) further comprises a step of applying an adhering element to adhere said bottom of said target materials to said block panel.

4. The process, as recited in claim 2, wherein the step (d) further comprises a step of applying an adhering element to adhere said bottom of said target materials to said block panel.

5. The process, as recited in claim 1, wherein the step (d) further comprises the step of providing a cushioning element at said bottom of said target materials to couple with said block panel.

6. The process, as recited in claim 4, wherein the step (d) further comprises the step of providing a cushioning element at said bottom of said target materials to couple with said block panel.

7. The process, as recited in claim 1, wherein an edge of said block panel is foldably coupled with an edge of said respective block body at one of said openings thereof, such that after said target materials are filled within said material compartment, said block panel is folded to couple with said block body and to close said respective opening thereof.

8. The process, as recited in claim 4, wherein an edge of said block panel is foldably coupled with an edge of said respective block body at one of said openings thereof, such that after said target materials are filled within said material compartment, said block panel is folded to couple with said block body and to close said respective opening thereof.

9. The process, as recited in claim 1, wherein said block panel is detachably coupled with said respective block body, such that after said target materials are filled within said material compartment, said block panel is affixed to couple with said block body and to close said one opening thereof.

10. The process, as recited in claim 4, wherein said block panel is detachably coupled with said respective block body, such that after said target materials are filled within said material compartment, said block panel is affixed to couple with said block body and to close said one opening thereof.

* * * * *